United States Patent [19]

Saaristo

[11] 4,102,061

[45] Jul. 25, 1978

[54] SHOE SOLE STRUCTURE

[75] Inventor: Seppo Saaristo, Vantaa, Finland

[73] Assignee: Karhu-Titan Oy, Finland

[21] Appl. No.: 773,655

[22] Filed: Mar. 2, 1977

[30] Foreign Application Priority Data

Mar. 8, 1976 [FI] Finland ..... 760588

[51] Int. Cl.[2] ..... A43B 13/18

[52] U.S. Cl. ..... 36/28; 36/3 B

[58] Field of Search ..... 36/3 B, 3 R, 28 R, 29

[56] References Cited

U.S. PATENT DOCUMENTS

| | | | |
|---|---|---|---|
| 2,741,038 | 4/1956 | Eliassen | 36/3 R |
| 2,885,797 | 5/1959 | Chrencik | 36/28 X |
| 2,917,844 | 12/1959 | Scholl | 36/3 B X |
| 3,225,463 | 12/1965 | Burnham | 36/3 R |

*Primary Examiner*—Alfred R. Guest

*Attorney, Agent, or Firm*—Steinberg & Blake

[57] ABSTRACT

A shoe has an insole, an outsole, and a midsole situated between the insole and outsole, with a wedge member being situated between the midsole and outsole at a heel region thereof and extending from the heel region toward an arch region thereof. This wedge member is formed with at least one opening situated at the heel region and extending downwardly from the midsole toward the outsole with the midsole and insole both having sufficient flexibility to extend at least partly into said opening in response to receiving the weight of the wearer of the shoe, so that the shoe can adapt itself to the shape of the foot of the wearer and contribute toward uniform support for the foot.

7 Claims, 4 Drawing Figures

SHOE SOLE STRUCTURE

BACKGROUND OF THE INVENTION

The present invention relates to shoes.

In particular, the present invention relates to sole structure of shoes and especially the sole structure of sport shoes.

The invention relates in particular to a sole construction which includes an insole, an outsole, and a midsole situated therebetween, with a wedge member situated between the midsole and outsole at a heel region thereof, extending from the heel region toward an arch region thereof, with this wedge member being integral with the outsole and/or midsole, or being in the form of a body separate from the midsole and outsole.

The facility with which a shoe, particularly a sport shoe, is used is determined to a large extent by the construction of its sole, and in particular by the elasticity of the entire sole and its capability of adapting itself itself so as to afford uniform support for feet of different shapes.

With conventional sole structures, particularly of known sport shoes, there is the drawback that since the sole must be relatively firm at the heel region, the sole is at the same time at the heel region of relatively low elasticity, so that it cannot adapt itself to differently shaped feet, with the result that a detrimental stress is imposed on the foot causing, for example, a descended arch and formation of a bone spike at the heel. A further drawback of conventional shoes of this type is the frequent development of sore toes, due to the fact that the foot unavoidably slips forwardly toward the tip of the shoe, and also due to perspiration of the foot.

SUMMARY OF THE INVENTION

It is accordingly a primary object of the present invention to provide a shoe which will avoid the above drawbacks.

It is in particular an object of the present invention to provide a shoe construction capable of firmly supporting the foot at the heel region thereof while at the same time being capable of adapting the shoe to feet of different shapes and affording a uniform support for the foot.

Also it is an object of the present invention to provide a construction of this type which will operate to prevent slipping of the foot toward the tip of the shoe.

In addition, it is an object of the present invention to provide a shoe construction which will greatly alleviate problems in connection with perspiration of a foot in a shoe.

In order to achieve the above objects, there is situated between the midsole and outsole of a shoe, at a heel region thereof, a wedge member which is formed with an opening in the form of one or more apertures, depressions, grooves, or the like, this opening or openings being situated at the heel region and if desired also toward the arch region. The latter opening or openings formed in the wedge member are situated at an upper region thereof next to the midsole while the midsole and insole are made of sufficient flexibility and elasticity to be capable of extending at least partly into the opening or openings in the wedge member so as to adapt the shoe to feet of various shapes and so as to afford a uniform support for the foot.

The midsole and/or the insole, particularly at their regions which are situated over the above opening or openings in the wedge member have a sufficient elasticity to be capable of extending downwardly with at least part of the midsole being received in the above opening or openings, and if the material used for the midsole and/or insole is not sufficiently elastic, these components can be punched, perforated, or otherwise treated so as to have their flexibility and elasticity increased.

With the structure of the invention there is the further advantage that the construction is such that it contributes at the same time to preventing the tendency of the foot to slip forwardly toward the tip of the shoe, so as to avoid in this way sore toes. Moreover, inasmuch as the midsole, together with the insole, move, when the shoe is worn during walking, running, or the like, alternately into and out of the above opening or openings in the wedge member, the midsole cooperates with the opening or openings in the wedge member to form a structure similar to a diaphragm pump, inasmuch as the volume of the opening or openings in the wedge member increases and decreases during movement of the elastic midsole and insole downwardly toward and upwardly away from the outsole during walking, running, or the like. This action is utilized in accordance with a further feature of the invention to ventilate the foot by achieving an air-conditioning of the interior of the shoe.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
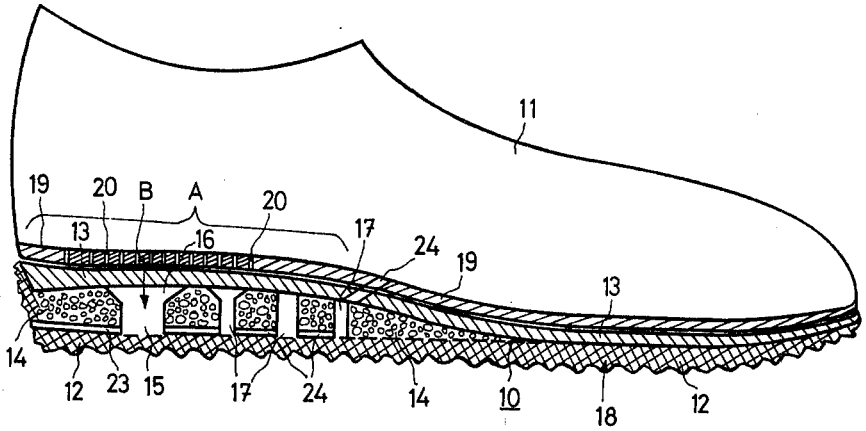
FIG. 1 is a schematic side elevation of a shoe according to the invention, with FIG. 1 showing the structure of the shoe sole in a longitudinal section.

Referring now to FIG. 1, the shoe illustrated therein has an upper 11 which is only schematically indicated inasmuch as the details thereof form no part of the present invention. The illustrated shoe has a sole 10 which is constructed in accordance with the present invention. This sole 10 has an outsole 12, an insole 19, and a midsole 13. Situated between the midsole 13 and the outsole 12 is a wedge member 14 located at the heel region of the midsole 13 and outsole 12 and extending from the heel region along the arch region as illustrated. This wedge member 14 can be integral with either one or both of the components 12 and 13, or it may be in the form of a separate body as illustrated. Thus, the components 12–14 may be made of a suitable rubber or plastic material and they can be fixed to each other as, for example, by a suitable cement. The wedge member 14 gives the sole 10 a desired configuration in particular at the heel portion thereof. The components 12 and 13 are in the form of elongated layers, while the outsole 12 has a bottom friction surface 18 of good wearing properties and made with a suitable relief pattern as is apparent from FIGS. 1, 3, and 4 and as is indicated schematically and fragmentarily in FIG. 2.

At the heel region or area A of the illustrated sole 10 of the shoe, where the heel and arch of the foot are situated when the shoe is worn, the wedge member 14 is formed, according to a particular feature of the invention, with at least one opening or aperture 15 situated substantially centrally of the heel region. This opening 15 extends downwardly from the lower surface of the midsole 13 toward the outsole 12. At its upper end next to the lower surface of the midsole 13 the opening 15 has its maximum area while having a tapered or chamferred portion 16 as illustrated.

The midsole 13 as well as the insole 19 are flexible and capable of elastically yielding in the direction of the arrow B shown in FIG. 1, so that under the load imposed on the sole at the heel region thereof the midsole 13 and insole 19 are capable of entering into the opening or aperture 15 at its tapered portion 16, thus enabling the shoe to adapt itself to differently shaped feet.

Figure 2:
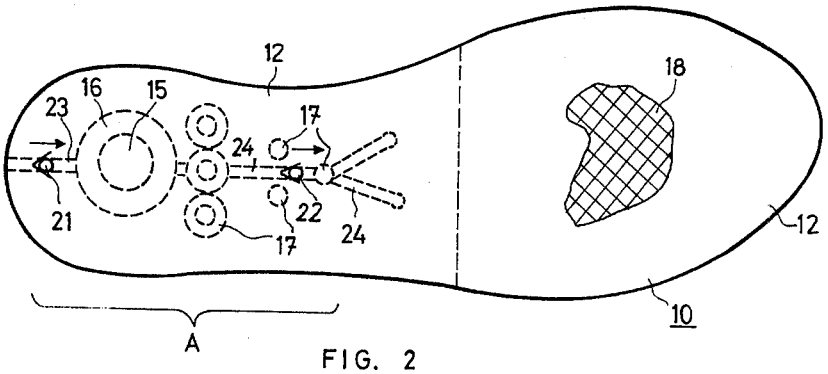
FIG. 2 shows the shoe of FIG. 1 as it appears when looking toward the bottom of the shoe with part of the bottom surface being fragmentarily indicated.

With the particular construction of the invention which is illustrated in the drawings, the wedge member is formed forwardly of the opening 15 with additional openings or apertures 17 which are of a smaller diameter than the opening 15 and which may be distributed, for example, in the manner apparent from FIGS. 1 and 2, so that in this way the elasticity and adaptability of the sole in this particular region is increased and/or the sole is relieved in this way. In accordance with the invention the wedge member 14 may be made of a relatively hard material, while still achieving the desired adaptability of the sole. If required, additional reinforcements increasing the rigidity of the wedge member 14 may be used in connection with the wedge member 14. The insole 19 is made of an inherently elastic material, and the adaptability thereof may be enhanced, if necessary, at the heel region by forming in the insole 19 a plurality of slits 20 which are cut or sliced through the insole 19 to achieve the structure shown schematically in FIG. 1.

As has been pointed out above, one of the drawbacks encountered particularly with known sports shoes is the undesirable effects resulting from perspiration of the foot. In order to avoid this drawback, it is possible according to a further feature of the invention to bring about a ventilation and air-conditioning of the interior of the shoe. In this connection reference is made particularly to FIGS. 3 and 4.

Figure 3:
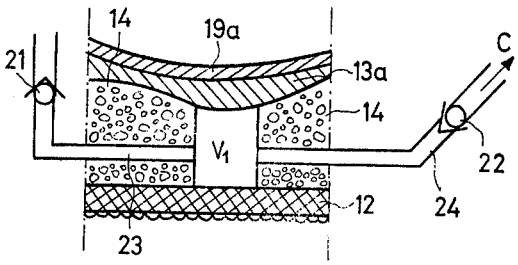
FIGS. 3 and 4 are schematic fragmentary sectional illustrations of the manner in which the structure of the invention operates to ventilate the interior of a shoe, this ventilating structure being combined with the shoe of the invention when required.

When the shoe is pressed toward the ground or floor therebeneath, during wearing of the shoe, the heel of the wearer presses down on the insole 19 and through the latter on the midsole 13, thus displacing these components downwardly into the opening 15 so as to decrease the volume thereof. The decreased volume $V_1$ of the opening 15 is indicated in FIG. 3. A passage means communicates with the opening 15, and this passage means includes an air-intake duct 23 which places the opening 15 in communication with the outer atmosphere. While the portion 23 of the passage means is shown schematically in FIGS. 3 and 4, it will be noted from FIG. 1, that the passage means 23 is shown in FIG. 1 extending along the lower region of the wedge member 14 at the upper surface of the outsole 12, this portion 23 of the passage means extending from the opening 15 to the rear of the sole as illustrated in FIG. 1. The passage means also includes an exhaust duct 24 leading from the opening 15 forwardly through the wedge member 14 and from the latter through the midsole 13 and insole 19 into the interior of the shoe, as is particularly apparent from FIGS. 1 and 2. Thus it will be seen that the exhaust duct 24 of the passage means extends forwardly from the opening 15 across a number of the openings 17 and from the forwardmost opening 17 of FIGS. 1 and 2 along a pair of branches through the midsole 13 and insole 19 into the interior of the shoe. The passage portion 23 is provided with a check valve 21, schematically illustrated in FIGS. 2–4, which permits air to flow only from the outer atmosphere into the opening 15, while the portion 24 of the passage means has a check valve 22 which permits the air to flow through the passage 24 only toward the interior of the shoe.

As the shoe is pressed against the floor or ground, the insole 19 and midsole 13 are depressed to assume the configurations **13*a* and 19*a* indicated in FIG. 3, so that the air which formerly was contained in the initial relatively large volume $V_2$ (FIG. 4) of the opening 15 is discharged in part through the duct 24 to the interior of the shoe. It will be noted that at least some of the openings 17 contribute to this effect also. Thus it will be seen that just in front of the largest opening 15 three openings 17 are distributed across the wedge member 14 with these openings also having upper tapered end regions into which the midsole 13 and insole 19 can partly extend as shown for the opening 15 in FIG. 3, so that the volume of air which is "pumped" is achieved not only from the opening 15 but in part also from at least some of the openings 17 in the particular example illustrated. Of course, in response to the reduction of volume which takes place when the shoe changes from the position of FIG. 4 to the position of FIG. 3, the air is prevented from passing to the outer atmosphere by way of the check valve 21 and by its increase in pressure automatically opens the valve 22** so as to flow the interior of the shoe. In this way it is possible to ventilate the foot of the wearer.

With this construction it is possible to provide in the upper 11 of the shoe air outlets at points which are situated with a view to achieving a proper ventilation.

Figure 4:
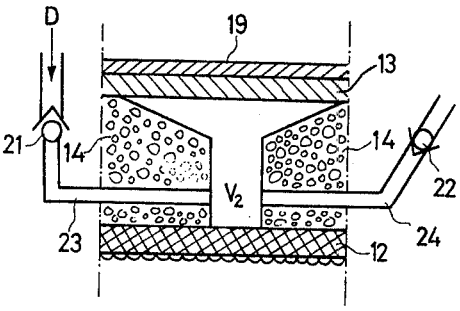

When, immediately after the shoe has the position indicated schematically in FIG. 3, the the individual wearing the shoe raises his foot in preparation for the next step, the shoe of course separates from the ground or floor previously engaged thereby, and due to the elasticity of components 13 and 19 they return to the condition indicated in FIG. 4, so that the volume of the opening 15 increases, thus bringing about closing of the valve 22 and opening of the valve 21 so that additional air is received in the opening 15 and of course in at least some of the openings 17 as set forth above. Thus, when air is displaced into the shoe the air flows in the direction indicated by the arrow C in FIG. 3, while when air flows from the outer atmosphere into the opening or openings in the wedge member 14 the air flows in the manner indicated by the arrow D in FIG. 4.

It is to be noted that the valves 21 and 22 schematically indicated in FIGS. 2–4 are not absolutely essential. It is possible even without these valves to achieve ventilation of the interior of the shoe. Thus, even without these valves due to the displacing of the midsole 13 and insole 19 into and out of the opening 15 and, in the particular example illustrated, at least some of the openings 17, air will flow back and forth through the passage means 23, 24 to achieve the desired ventilation effect. In the event that valves 21 and 22 are not utilized it may be desirable to provide additional passages 23 and 24.

It is to be noted that with the structure of the invention, in addition to achieving the advantages set forth above, there is the additional advantage of reducing the weight of the shoe without detracting from the required firmness of the sole. Moreover, although reference has been made above to a wedge member, the invention is equally applicable to sole constructions where the wedge member which gives the sole a desired configuration is not truly wedge-shaped and is integral with the midsole 13 and/or the outsole 12. With such a construction it is possible to achieve the results of the invention by forming the sole with suitable recesses, bores, and the like at suitable locations.

Of course, the invention is not to be confined to the particular details set forth above and shown in the drawings, inasmuch as these details may vary within the scope of the inventive concept as defined by the claims which follow.

What is claimed is:

1. In a shoe, an insole, an outsole, and a midsole situated between said insole and outsole, and a wedge member situated between said midsole and outsole at a heel region thereof and extending from said heel region toward an arch region of said midsole and outsole, said wedge member having an upper region situated next to said midsole and being formed with at least one opening extending from said midsole at said upper region of said wedge member downwardly toward said outsole, said opening having a maximum area directly next to said midsole at the lower surface thereof and tapering downwardly for at least part of the distance from said midsole said insole and midsole both being of sufficient flexibility to extend at least partly into said opening of said wedge member when the shoe is worn with the foot of the wearer pressing downwardly on said insole and through the latter on said midsole, whereby the shoe can adapt itself to differently shaped feet while affording a uniform support for the foot, said insole and midsole cooperating with said opening for decreasing the volume thereof when said insole and midsole are displaced downwardly when receiving the weight of a foot in said shoe with said insole and midsole having sufficient elasticity to move outwardly of said opening, increasing the volume thereof, when the weight of the foot is not transmitted to said wedge member.

2. The combination of claim 1 and wherein said opening of said wedge member is situated substantially centrally of said heel region.

3. The combination of claim 2 and wherein said wedge member is formed forwardly of said opening with a plurality of additional smaller openings also extending downwardly from said midsole toward said outsole.

4. In a shoe, an insole, and outsole, and a midsole situated between said insole and outsole, and a wedge member situated between said midsole and outsole at a heel region thereof and extending from said heel region toward an arch region of said midsole and outsole, said wedge member having an upper region situated next to said midsole and being formed with at least one opening extending from said midsole at said upper region of said wedge member downwardly toward said outsole, said insole and midsole both being of sufficient flexibility to extend at least partly into said opening of said wedge member when the shoe is worn with the foot of the wearer pressing downwardly on said insole and through the latter on said midsole, whereby the shoe can adapt itself to differently shaped feet while affording a uniform support for the foot; said insole and midsole cooperating with said opening for decreasing the volumn thereof when said insole and midsole are displaced downwardly when receiving the weight of a foot in said shoe with said insole and midsole having sufficient elasticity to move outwardly of said opening, increasing the volume thereof, when the weight of the foot is not transmitted said wedge member, and passage means extending from said opening at least through said midsole and insole for ventilating the interior of the shoe due to the increase and decrease in the volume of said opening while the shoe is worn.

5. The combination of claim 4 and wherein said passage means has a portion extending from said opening to the outer atmosphere.

6. The combination of claim 5 and wherein a check-valve means cooperates with said passage means for permitting air to travel only from the outer atmosphere into the interior of a shoe.

7. The combination of claim 6 and wherein said passage means extends in part through said wedge member.

* * * * *